United States Patent [19]

Allie

[11] Patent Number: 4,837,834

[45] Date of Patent: Jun. 6, 1989

[54] ACTIVE ACOUSTIC ATTENUATION SYSTEM WITH DIFFERENTIAL FILTERING

[75] Inventor: Mark C. Allie, Oregon, Wis.

[73] Assignee: Nelson Industries, Inc., Stoughton, Wis.

[21] Appl. No.: 189,994

[22] Filed: May 4, 1988

[51] Int. Cl.[4] ..... G10K 11/16

[52] U.S. Cl. ..... 381/71; 381/94

[58] Field of Search ..... 381/71, 94

[56] References Cited

U.S. PATENT DOCUMENTS

| | | | |
|---|---|---|---|
| 4,480,333 | 10/1984 | Ross | 381/71 |
| 4,665,549 | 5/1987 | Eriksson et al. | 381/71 |
| 4,677,676 | 6/1987 | Eriksson | 381/71 |
| 4,677,677 | 6/1987 | Eriksson | 381/71 |
| 4,736,431 | 4/1988 | Allie et al. | 381/71 |

OTHER PUBLICATIONS

M. A. Swinbanks, "The Active Control of Sound Propagation in Long Ducts", *Journal of Sound and Vibration*, (1973), 27(3), 411–436.

B. A. Brown et al., VLSI Systems Design for Digital Signal Processing, vol. I: Signal Processing and Signal Processors, Prentice-Hall, Inc., Englewood Cliffs, N.J., p. 11.

*Primary Examiner*—Forester W. Isen

*Attorney, Agent, or Firm*—Andrus, Sceales, Starke & Sawall

[57] ABSTRACT

An adaptive active acoustic attenuation system is provided with extended frequency range to attenuate undesired noise which was previously filtered out to avoid instability of the adaptive model. The input signal from the input microphone to the model and the error signal from the error microphone to the model are differentially bandpass filtered to provide a narrower frequency range error signal. In one embodiment, the model operates in its stable region to provide accurate well behaved correction signals to the cancelling loudspeaker, while still receiving a low frequency input noise signal from the input microphone including frequencies below such range. Minimum attenuation frequency has been reduced by at least an octave.

36 Claims, 4 Drawing Sheets

ACTIVE ACOUSTIC ATTENUATION SYSTEM WITH DIFFERENTIAL FILTERING

BACKGROUND AND SUMMARY

The present invention arose during continuing development efforts relating to the subject matter of U.S. application Ser. No. 07/168,932, filed Mar. 16, 1988, and U.S. Pat. Nos. 4,665,549, 4,677,676, 4,677,677, 4,736,431, incorporated herein by reference.

The present invention involves differential bandpass filtering of the error signal to a narrower range than the input signal to improve system performance by reducing the range of modeling away from the cut-off frequencies of the input signal where sharp bandpass filtering is otherwise required to minimize regions of instabilities due to rapid phase change near the cut-off frequencies of the bandpass filtering.

DETAILED DESCRIPTION

PRIOR ART

Figure 1:
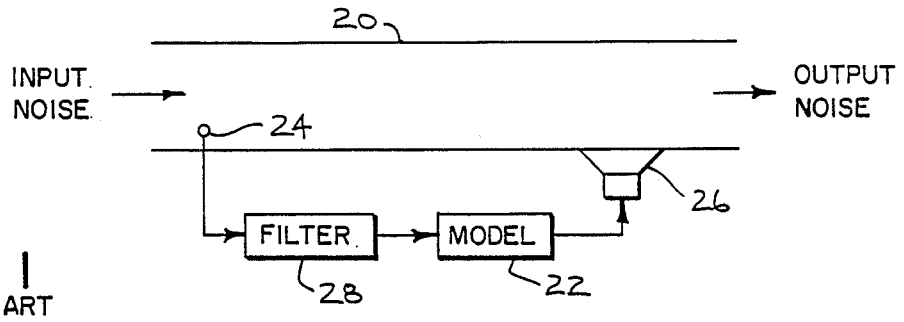
FIG. 1 PRIOR ART
FIG. 1 shows a filtered nonadaptive system known in the prior art.

Filters are often required in active noise control systems to restrict system performance to the operational range of the controller and transducers. FIG. 1 shows a nonadaptive noise control system as known in the prior art. Input noise from an industrial fan, etc., enters a duct 20. The section of duct 20 between input microphone 24 and loudspeaker 26 is known in control theory as the plant. A model 22 of the plant and inverse of the filter 28 is determined beforehand and is fixed. The model senses the input noise at microphone 24 and outputs a cancelling soundwave at loudspeaker 26 to cancel or minimize the undesired noise. A sharp bandpass filter 28 is provided to minimize the region of instability due to rapid phase changes near cut-off frequency, M. A. Swinbanks, "The Active Control of Sound Propagation in Long Ducts", *Journal of Sound and Vibration* (1973) 27(3) 411–436, pages 432 and 435. Model 22 must include a representation of the inverse of the filter. The inverse of the filter at the cut-off frequency is difficult to be accurately represented by the model.

Figure 2:
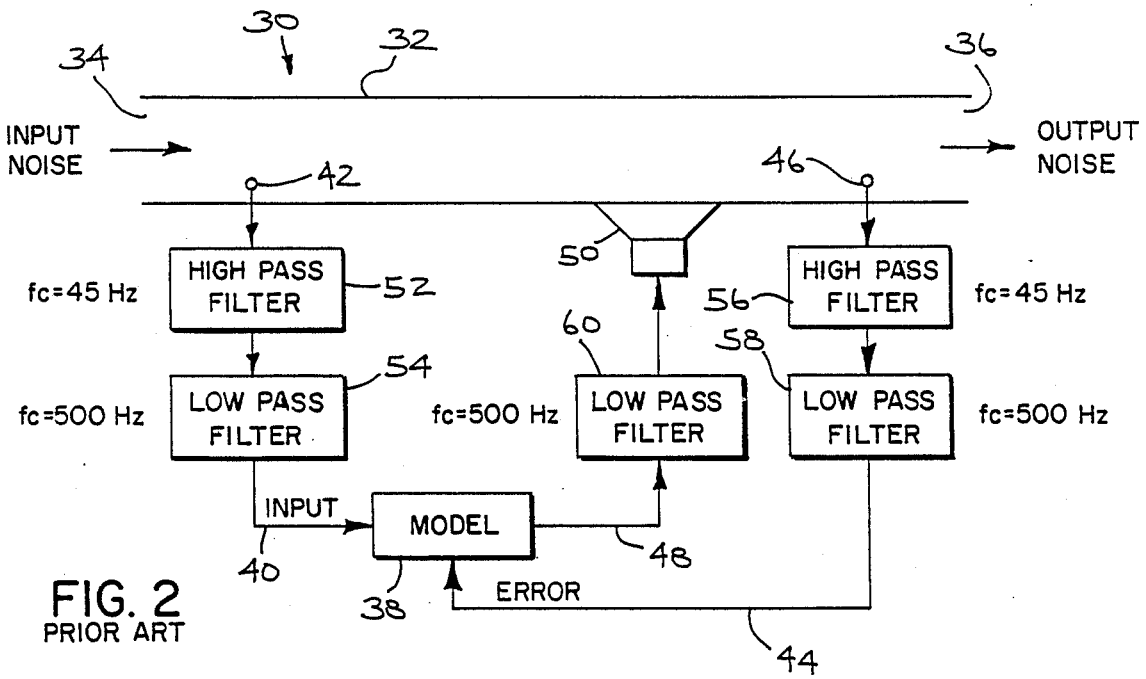
FIG. 2 PRIOR ART
FIG. 2 shows a filtered adaptive system known in the prior art.

In adaptive active noise control systems, the model is not fixed, but rather changes and adapts to the sensed input noise, for example as shown and described in the above incorporated patents. FIG. 2 shows an acoustic system 30 including an axially extending duct 32 having an input 34 for receiving an input acoustic wave and an output 36 for radiating an output acoustic wave. The acoustic wave providing the noise propagates axially left to right through the duct. The acoustic system is modeled with an adaptive filter model 38 having a model input 40 from input microphone or transducer 42, and an error input 44 from error microphone or transducer 46, and outputting a correction signal at 48 to omnidirectional output speaker or transducer 50 to introduce a cancelling acoustic wave such that the error signal at 44 approaches a given value such as zero. The cancelling acoustic wave from output transducer 50 is introduced into duct 32 for attenuating the output acoustic wave. Error transducer 46 senses the combined output acoustic wave and cancelling acoustic wave and provides an error signal at 44.

It is known in the prior art to bandpass filter the input signal at 40 and the error signal at 44 with appropriate highpass and lowpass filters. The lowpass filters avoid "aliasing" and "imaging" problems, B. A. Bowen et al, *VLSI Systems Design for Digital Signal Processing*, Volume 1: *Signal Processing and Signal Processors*, Prentice-Hall, Inc., Englewood Cliffs, N.J., page 11. The highpass filters restrict the input and error signals to regions where loudspeaker 50 can create noise and model 38 can effectively model the plant and inverse of the filters. The problem with the system of FIG. 2, as with the system of FIG. 1, is that the model must represent the inverse of the filters, and this is difficult to do well at the cut-off frequency of the highpass filters due to complex changes in phase and amplitude of the signal.

Loudspeakers are usually ineffective sound generators at frequencies below about 20 Hertz. Thus, in FIG. 2, it would be desirable to set the cut-off frequency of the highpass filters at about 20 Hertz, to thus allow only frequencies greater than 20 Hertz into the system. However, signals for frequencies just slightly greater than 20 Hertz exhibit the noted complex and rapid changes in phase and amplitude and cause instability of system operation. This is because the model, even though it can be made very accurate with digital processing technology and through the use of a recursive least means square algorithm, still has a limited number of coefficients and limited resolution in time. Thus, since the model must include a representation of the inverse of the filters, the computational task of the adaptive model becomes more and more difficult as the changes in phase and amplitude of the input signal become more complex near the cut-off frequencies of the filters.

A solution known in the prior art has been to increase the cut-off frequency of the highpass filters so that the model is better able to model the inverse of the highpass filters. This solution is shown in FIG. 2 where the input signal is highpass filtered with a highpass filter 52 having a cut-off frequency of 45 Hertz and is lowpass filtered with a lowpass filter 54 having a cut-off frequency of 500 Hertz. The error signal is highpass filtered with a highpass filter 56 having a cut-off frequency of 45 Hertz and is lowpass filtered with a lowpass filter 58 having a cut-off frequency of 500 Hertz. The correction signal is lowpass filtered with a lowpass filter 60 having a cut-off frequency of 500 Hertz.

The problem with the noted solution is that it causes loss of low frequency performance. This trade-off is unacceptable in various applications including industrial sound control where many of the noises desired to be attenuated are in a low frequency range, for example industrial fans and the like. The present invention addresses and solves the noted problem without the trade-off of loss of low frequency performance.

PRESENT INVENTION

In the present invention, it has been found that if the error signal at 44 is bandpass filtered to a narrower range than the input signal at 40, then the system can attenuate the desired low frequency noise. It has particularly been found that the cut-off frequency of the highpass filter for the input signal can be significantly lowered, to thus accept lower frequencies, if the cut-off frequency of the highpass filter for the error signal is kept high enough to exclude from the adaptive process those frequencies which would otherwise cause instability of the model.

Figure 3:
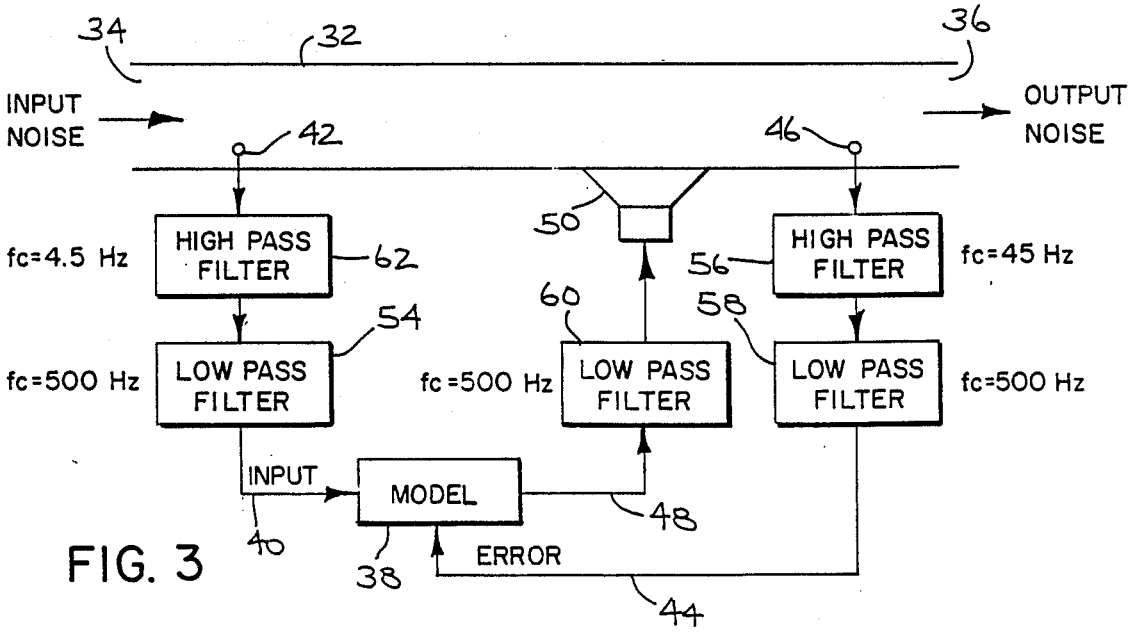
FIG. 3 shows a system in accordance with the invention.

FIG. 3 shows the simplest form of the invention and uses like reference numerals from FIG. 2 where appropriate to facilitate clarity. The input signal is highpass filtered at highpass filter 62 to a cut-off frequency of 4.5 Hertz. The cut-off frequency of highpass filter 56 remains at 45 Hertz. For the frequency range 45 Hertz to 500 Hertz, the input filter and its inverse are well behaved with a relatively flat response and with relatively small changes in amplitude and phase, FIGS. 4 and 6. Thus, while input highpass filter 62 accepts frequencies lower than 45 Hertz, the adaptive modeling process which models the plant and the inverse of the input filter, is better behaved, with less chance of instability because the range of modeling is limited, FIG. 5, to the flat smooth portion 68, FIG. 6, of the input filter response away from the lower frequency region 70 where instability occurs.

Even though the range of modeling is limited to the region of flat error filter response, it has neverthless been found that significant attenuation of low frequency noise below the error path highpass filter cut-off frequency has resulted. It has been found that the lower limit of attenuated frequency has been reduced by at least an octave, i.e. a 2:1 reduction, which is dramatic. Instead of the lower limit of attenuation being about 45 Hertz, such lower limit has been reduced with the present invention to below about 20 Hertz. This significantly expands the scope of industrial application, where such low frequency noises are present.

Figure 4:
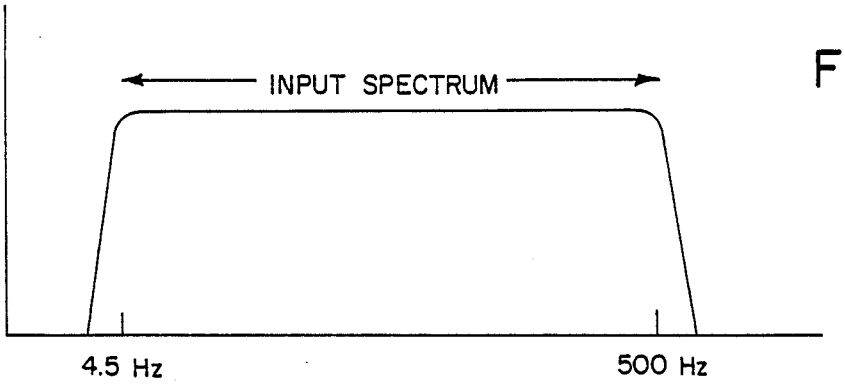
FIGS. 4–6 are graphs of filter response showing input and error spectrums, with acoustic wave frequency on a log scale on the horizontal axis and log acoustic wave amplitude on the vertical axis.
Figure 5:
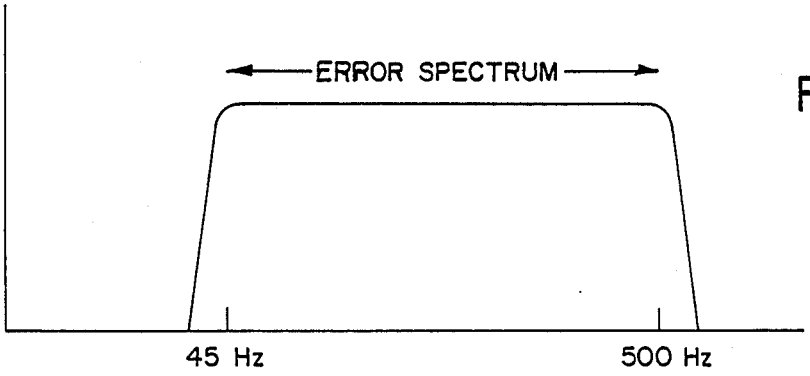
Figure 6:
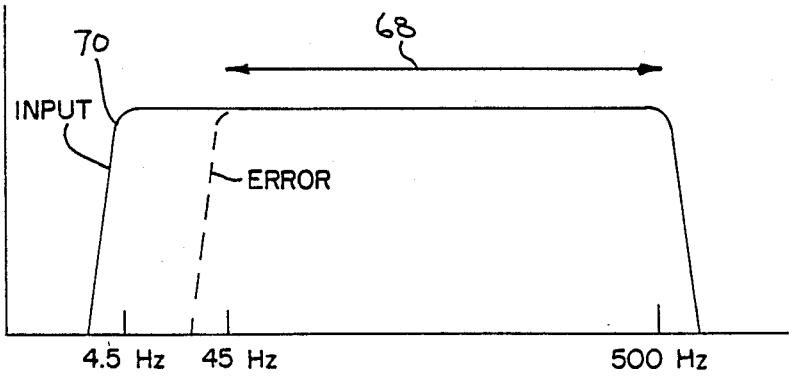

As seen in FIG. 5, the bandpass filtered error signal spectrum is from 45 Hertz to 500 Hertz. As seen in FIG. 4, the bandpass filtered input signal spectrum is from 4.5 Hertz to 500 Hertz. FIG. 6 shows FIGS. 4 and 5 superimposed. Region 68 shows the relatively flat well behaved range of the modeling process for the input filter response away from the region 70 of instability of the otherwise modeled inverse input filter.

Figure 7:
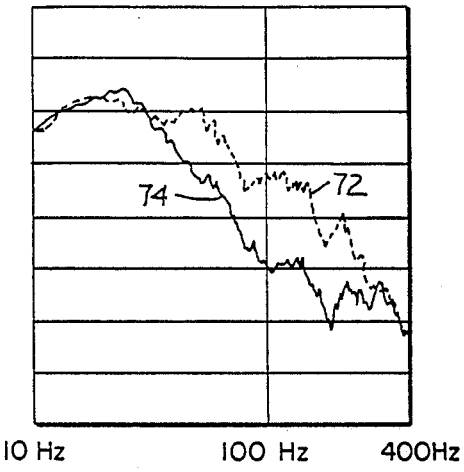
FIGS. 7–12 are graphs showing performance of the variously described systems, with acoustic wave frequency on a log scale on the horizontal axis and log acoustic wave amplitude on the vertical axis.
Figure 8:
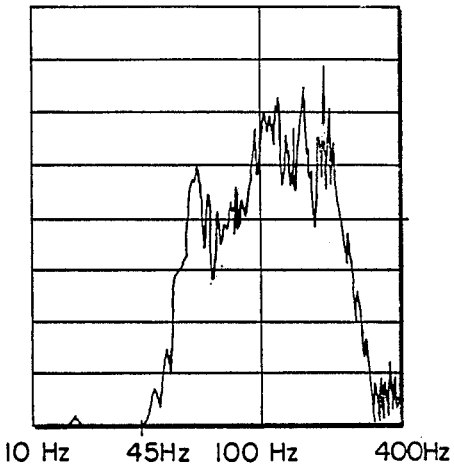

FIG. 7 shows noise before and after cancellation at 72 and 74, respectively, for the acoustic system of FIG. 2. FIG. 8 shows the difference in amplitude between the cancelled and uncancelled noise of FIG. 7, such that the greater the vertical height in FIG. 8, the more the attenuation. In FIG. 8, attenuation starts at about 45 Hertz.

Figure 9:
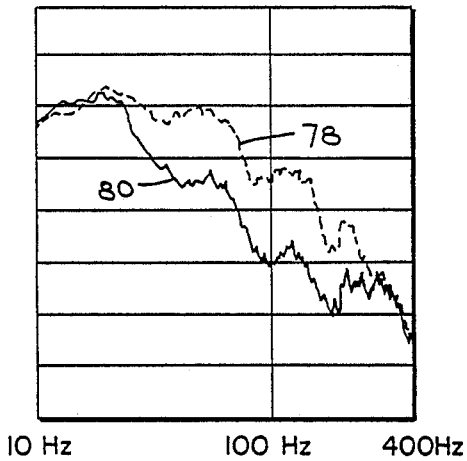
Figure 10:
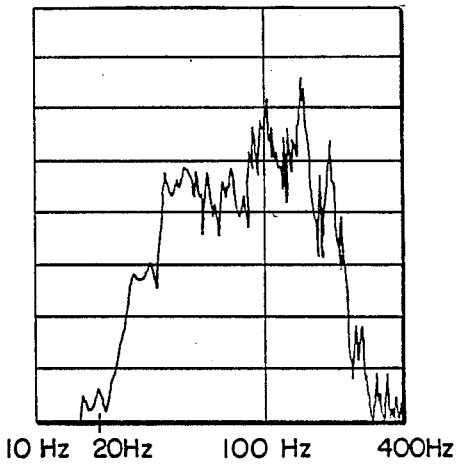

FIG. 9 shows noise before and after cancellation at 78 and 80, respectively, for the system of FIG. 3. FIG. 10 shows the difference in amplitude of the cancelled and uncancelled noise of FIG. 9, and shows that attenuation begins at a value less than about 20 Hertz. This is a significant improvement over FIG. 8 because the minimum attenuation frequency has been lowered by at least an octave, which is a dramatic reduction.

When the cut-off frequency for both the input signal highpass filter 52 and the error signal highpass filter 56 is reduced to 20 Hz, the system was unstable, and hence data for same is not shown. When the cut-off frequency for each of filters 52 and 56 is reduced to 4.5 Hz, the system is unstable.

Figure 13:
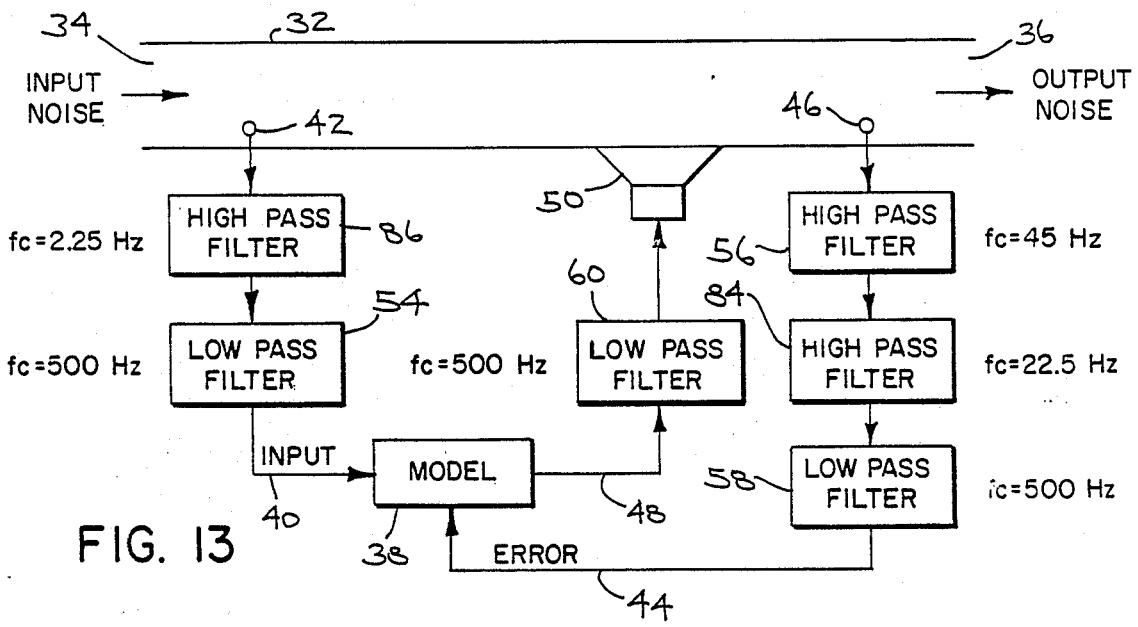
FIG. 13 shows another system in accordance with the invention.

FIG. 13 shows a further embodiment of an acoustic system in accordance with the invention and uses like reference numerals from FIG. 3 where appropriate to facilitate clarity. A second highpass filter 84 highpass filters the error signal at a cut-off frequency of 22.5 Hertz. The input signal is highpass filtered by highpass filter 86 to a cut-off frequency of 2.25 Hertz.

Figure 11:
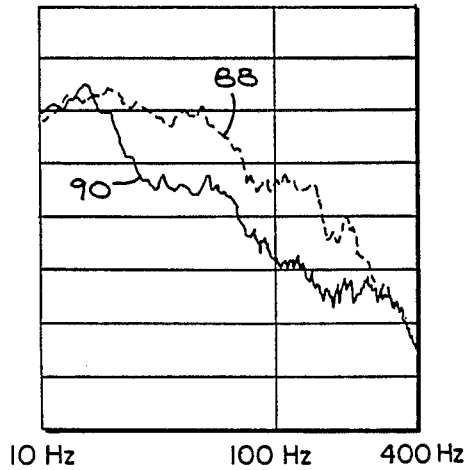
Figure 12:
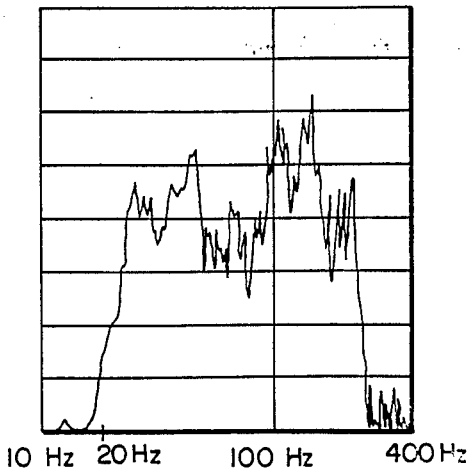

FIG. 11 shows noise before and after cancellation at 88 and 90, respectively, for the system of FIG. 13. FIG. 12 shows the difference in amplitude of the cancelled and uncancelled noise of FIG. 11, and shows reduction of the minimum frequency at which attenuation begins.

In each of FIGS. 3 and 13, the acoustic system is modeled with an adaptive recursive filter model having a transfer function with both poles and zeros, as in the above incorporated patents. The system provides adaptive compensation for feedback to input transducer 42 from output transducer 50 for both broadband and narrow band acoustic waves on-line without off-line pre-training. The system provides adaptive compensation of the error path from output transducer 50 to error transducer 46 and also provides adaptive compensation of output transducer 50 on-line without off-line pre-training. The feedback path from output transducer 50 to input transducer 42 is modeled with the same model 38 by modeling the feedback path as part of the model such that the latter adaptively models both the acoustic system and the feedback path, without separate modeling of the acoustic system and the feedback path, and without a separate model pre-trained off-line solely to the feedback. Each of the systems in FIGS. 3 and 13 also includes an auxiliary noise source, shown in above incorporated U.S. Pat. No. 4,677,676, introducing auxiliary noise into the model, such that error transducer 46 also senses the auxiliary noise from the auxiliary noise source. The auxiliary noise is random and uncorrelated to the input acoustic wave.

Figure 14:
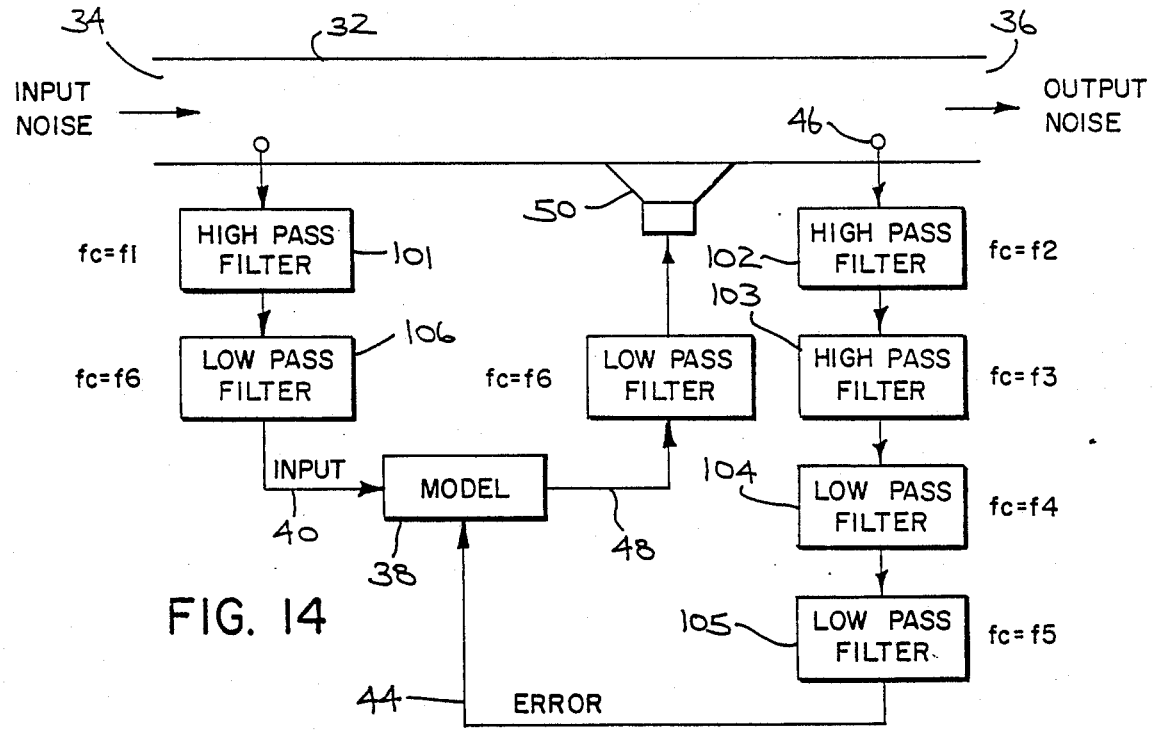
FIG. 14 shows a further system in accordance with the invention.
Figure 15:
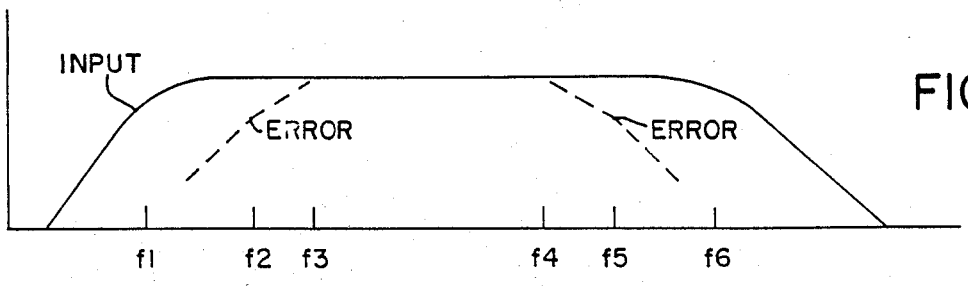
FIG. 15 is a graph illustrating operation and filter response of the system of FIG. 14, with acoustic wave frequency on a log scale on the horizontal axis and log acoustic wave amplitude on the vertical axis.

FIG. 14 shows a further acoustic system in accordance with the invention and uses like reference numerals from FIGS. 3 and 13 where appropriate to facilitate clarity. The input signal is highpass filtered at highpass filter 101 having a cut-off frequency f1, and is lowpass filtered by lowpass filter 106 having a cut-off frequency f6. The error signal is highpass filtered by highpass filter 102 having a cut-off frequency f2, and is highpass filtered by highpass filter 103 having a cut-off frequency f3. The error signal is lowpass filtered by lowpass filter 104 having a cut-off frequency f4, and is lowpass filtered by lowpass filter 105 having a cut-off frequency f5. In the embodiment shown, and as illustrated in FIG. 15, $f1 < f2 \leqq f3 \leqq f4 \leqq f5 \leqq f6$. Highpass filters 102 and 103 provide multiple stage highpass filtering of the error signal. Lowpass filters 104 and 105 provide multiple state lowpass filtering of the error signal. This multi-stage filtering shapes the filter response at the roll-off frequency. The frequency band between the lowpass filtered input signal and the highpass filtered input signal is greater than the frequency band between the multi-stage lowpass filtered error signal and the multi-stage highpass filtered error signal.

The invention is not limited to plane wave propagation, and may be used with higher order modes, for example above noted copending application Ser. No. 07/168,932, filed Mar. 16, 1988 "ACTIVE ACOUSTIC ATTENUATION SYSTEM FOR HIGHER ORDER MODE NON-UNIFORM SOUND FIELD IN A DUCT". The invention is not limited to acoustic waves in gases, e.g. air, but may also be used for elastic waves in solids, liquid filled systems, etc.

It is recognized that various equivalents, alternatives and modifications are possible within the scope of the appended claims.

I claim:

1. In an acoustic system having an input for receiving an input acoustic wave and an output for radiating an output acoustic wave, an active attenuation method for attenuating undesirable said output acoustic wave by introducing a cancelling acoustic wave from an output transducer, comprising:

sensing said input acoustic wave with an input transducer and providing an input signal;

sensing the combined said output acoustic wave and said cancelling acoustic wave from said output transducer with an error transducer and providing an error signal;

modeling said acoustic system with an adaptive filter model having a model input from said input transducer and an error input from said error transducer and outputting a correction signal to said output transducer to introduce the cancelling acoustic wave such that said error signal approaches a given value;

bandpass filtering said input signal;

bandpass filtering said error signal to a narrower range than said bandpass filtered input signal.

2. The invention according to claim 1 comprising modeling said acoustic system with an adaptive recursive said filter model having a transfer function with both poles and zeros.

3. The invention according to claim 1 comprising introducing auxiliary noise into said model from an auxiliary noise source, such that said error transducer also senses the auxiliary noise from said auxiliary noise source, said auxiliary noise being random and uncorrelated to said input acoustic wave.

4. The invention according to claim 1 comprising:

adaptively compensating for feedback to said input from said output transducer for both broadband and narrow band acoustic waves on-line without off-line pre-training, and providing both adaptive error path compensation and adaptive compensation of said output transducer on-line without off-line pre-training;

modeling the feedback path from said output transducer to said input transducer with the same said model by modeling said feedback path as part of said model such that the latter adaptively models both said acoustic system and said feedback path, without separate modeling of said acoustic system and said feedback path, and without a separate model pre-trained off-line solely to said feedback path.

5. In an acoustic system having an input for receiving an input acoustic wave and an output for radiating an output acoustic wave, an active attenuation method for attenuating undesirable said output acoustic wave by introducing a cancelling acoustic wave from an output transducer, comprising:

sensing said input acoustic wave with an input transducer and providing an input signal;

sensing the combined said output acoustic wave and said cancelling acoustic wave from said output transducer with an error transducer and providing an error signal;

modeling said acoustic system with an adaptive filter model having a model input from said input transducer and an error input from said error transducer and outputting a correction signal to said output transducer to introduce the cancelling acoustic wave such that said error signal approaches a given value;

highpass filtering said error signal;

highpass filtering said input signal to a lower cut-off frequency than said highpass filtered error signal.

6. The invention according to claim 5 comprising:

highpass filtering said error signal at a cut-off frequency less than about 50 Hertz;

highpass filtering said input signal at a cut-off frequency less than about 5 Hertz.

7. The invention according to claim 6 comprising:

highpass filtering said error signal at a cut-off frequency of about 45 Hertz;

highpass filtering said input signal at a cut-off frequency of about 4 Hertz.

8. The invention according to claim 5 comprising modeling said acoustic system with an adaptive recursive said filter model having a transfer function with both poles and zeros.

9. The invention according to claim 5 comprising introducing auxiliary noise into said model from an auxiliary noise source, such that said error transducer also senses the auxiliary noise from said auxiliary noise source, said auxiliary noise being random and uncorrelated to said input acoustic wave.

10. The invention according to claim 5 comprising:

adaptively compensating for feedback to said input from said output transducer for both broadband and narrow band acoustic waves on-line without off-line pre-training, and providing both adaptive error path compensation and adaptive compensation of said output transducer on-line without off-line pre-training;

modeling the feedback path from said output transducer to said input transducer with the same said model by modeling said feedback path as part of said model such that the latter adaptively models both said acoustic system and said feedback path, without separate modeling of said acoustic system and said feedback path, and without a separate model pre-trained off-line solely to said feedback path.

11. In an acoustic system having an input for receiving an input acoustic wave and an output for radiating an output acoustic wave, an active attenuation method for attenuating undesirable said output acoustic wave by introducing a cancelling acoustic wave from an output transducer, comprising:

sensing said input acoustic wave with an input transducer and providing an input signal;

sensing the combined said output acoustic wave and said cancelling acoustic wave from said output transducer with an error transducer and providing an error signal;

modeling said acoustic system with an adaptive filter model having a model input from said input transducer and an error input from said error transducer and outputting a correction signal to said output transducer to introduce the cancelling acoustic wave such that said error signal approaches a given value;

highpass filtering said error signal;

highpass filtering said input signal to a lower cut-off frequency than said highpass filtered error signal;

lowpass filtering said error signal;

lowpass filtering said input signal.

12. The invention according to claim 11 comprising lowpass filtering said error signal and said input signal to the same cut-off frequency.

13. The invention according to claim 11 comprising lowpass filtering said input signal to a higher cut-off frequency than said lowpass filtered error signal.

14. The invention according to claim 11 comprising:

highpass filtering said error signal at a cut-off frequency less than about 50 Hertz;

highpass filtering said input signal at a cut-off frequency less than about 5 Hertz;

lowpass filtering said error signal at a cut-off frequency greater than about 400 Hertz;

lowpass filtering said input signal at a cut-off frequency greater than about 400 Hertz.

15. In an acoustic system having an input for receiving an input acoustic wave and an output for radiating an output acoustic wave, an active attenuation system method for attenuating undesirable said output acoustic waves by introducing a cancelling acoustic wave from an output transducer, comprising:

sensing said input acoustic wave with an input transducer and providing an input signal;

sensing the combined said output acoustic waves and said cancelling acoustic wave from said output transducer with an error transducer and providing an error signal;

modeling said acoustic system with an adaptive filter model having a model input from said input transducer and an error input from said error transducer and outputting a correction signal to said output transducer to introduce the cancelling acoustic wave such that said error signal approaches a given value;

lowpass filtering said input signal;

highpass filtering said input signal;

lowpass filtering said error signal at one stage;

lowpass filtering said error signal at another stage to a lower cut-off frequency than said one stage;

highpass filtering said error signal at one stage;

highpass filtering said error signal at another stage to a higher cut-off frequency than said one stage highpass filtered error signal;

said cut-off frequency of said other stage lowpass filtered error signal being greater than the cut-off frequency of said other stage highpass filtered error signal;

the frequency band between said lowpass filtered input signal and said highpass filtered input signal being greater than the frequency band between said other stage lowpass filtered error signal and said other stage highpass filtered error signal.

16. The invention according to claim 15 comprising lowpass filtering said error signal at said one stage to a lower cut-off frequency than said lowpass filtered input signal.

17. The invention according to claim 15 comprising highpass filtering said error signal at said one stage to a higher cut-off frequency than said highpass filtered input signal.

18. The invention according to claim 15 comprising:

lowpass filtering said error signal at said one stage to a lower cut-off frequency than said lowpass filtered input signal;

highpass filtering said error signal at said one stage to a higher cut-off frequency than said highpass filtered input signal.

19. In an acoustic system having an input for receiving an input acoustic wave and an output for radiating an output acoustic wave, active attenuation apparatus for attenuating undesirable said output acoustic wave by introducing a cancelling acoustic wave from an output transducer, comprising:

an input transducer sensing said input acoustic wave and providing an input signal;

an error transducer sensing the combined said output acoustic wave and said cancelling acoustic wave from said output transducer and providing an error signal;

an adaptive filter model adaptively modeling said acoustic system and having a model input from said input transducer and an error input from said error transducer and outputting a correction signal to said output transducer to introduce the cancelling acoustic wave such that said error signal approaches a given value;

a first bandpass filter filtering said input signal;

a second bandpass filter filtering said error signal to a narrower range than said bandpass filtered input signal.

20. The invention according to claim 19 wherein said model comprises an adaptive recursive filter model having a transfer function with both poles and zeros.

21. The invention according to claim 19 comprising an auxiliary noise source introducing auxiliary noise into said model which is random and uncorrelated to said input acoustic wave, such that said error transducer also senses the auxiliary noise from said auxiliary noise source.

22. The invention according to claim 19 wherein said filter model adaptively models said acoustic system on-line without dedicated off-line pre-training, and also adaptively models the feedback path from said output transducer to said input transducer on-line for broadband and narrowband acoustic waves without dedicated off-line pre-training, and wherein said model comprises means adaptively modeling said feedback path as part of said model itself without a separate model dedicated solely to said feedback path and pre-trained thereto.

23. In an acoustic system having an input for receiving an input acoustic wave and an output for radiating an output acoustic wave, active attenuation apparatus for attenuating undesirable said output acoustic wave by introducing a cancelling acoustic wave from an output transducer, comprising:

an input transducer sensing said input acoustic wave and providing an input signal;

an error transducer sensing the combined said output acoustic wave and said cancelling acoustic wave from said output transducer and providing an error signal;

an adaptive filter model adaptively modeling said acoustic system and having a model input from said input transducer and an error input from said error transducer and outputting a correction signal to said output transducer to introduce the cancelling acoustic wave such that said error signal approaches a given value;

a first highpass filter filtering said error signal;

a second highpass filter filtering said input signal to a lower cut-off frequency than said highpass filtered error signal.

24. The invention according to claim 23 wherein:

said first highpass filter filters said error signal at a cut-off frequency less than about 50 Hertz;

said second highpass filter filters said input signal at a cut-off frequency less than about 5 Hertz.

25. The invention according to claim 24 herein:

said first highpass filter filters said error signal at a cut-off frequency of about 45 Hertz;

said second highpass filter filters said input signal at a cut-off frequency of about 4 Hertz.

26. The invention according to claim 23 wherein said model comprises an adaptive recursive filter model having a transfer function with both poles and zeros.

27. The invention according to claim 23 comprising an auxiliary noise source introducing auxiliary noise into said model which is random and uncorrelated to said input acoustic wave, such that said error transducer also senses the auxiliary noise from said auxiliary noise source.

28. The invention according to claim 23 wherein said filter model adaptively models said acoustic system on-line without dedicated off-line pre-training, and also adaptively models the feedback path from said output transducer to said input transducer on-line for broadband and narrowband acoustic waves without dedicated off-line pre-training, and wherein said model comprises means adaptively modeling said feedback path as part of said model itself without a separate model dedicated solely to said feedback path and pre-trained thereto.

29. In an acoustic system having an input for receiving an input acoustic wave and an output for radiating an output acoustic wave, active attenuation apparatus for attenuating undesirable said output acoustic wave by introducing a cancelling acoustic wave from an output transducer, comprising:

an input transducer sensing said input acoustic wave and providing an input signal;

an error transducer sensing the combined said output acoustic wave and said cancelling acoustic wave from said output transducer and providing an error signal;

an adaptive filter model adaptively modeling said acoustic system and having a model input from said input transducer and an error input from said error transducer and outputting a correction signal to said output transducer to introduce the cancelling acoustic wave such that said error signal approaches a given value;

a first highpass filter filtering said error signal;

a second highpass filter filtering said input signal to a lower cut-off frequency than said highpass filtered error signal;

a first lowpass filter filtering said error signal;

a second lowpass filter filtering said input signal.

30. The invention according to claim 29 wherein said first and second lowpass filters have the same cut-off frequency.

31. The invention according to claim 29 wherein said second lowpass filter has a higher cut-off frequency than said first lowpass filter.

32. The invention according to claim 29 wherein said first highpass filter has a cut-off frequency less than about 50 Hertz;

said second highpass filter has a cut-off frequency less than about 5 Hertz;

said first lowpass filter has a cut-off frequency greater than about 400 Hertz;

said second lowpass filter has a cut-off frequency greater than about 400 Hertz.

33. In an acoustic system having an input for receiving an input acoustic wave and an output for radiating an output acoustic wave, active attenuation apparatus for attenuating undesirable said output acoustic wave by introducing a cancelling acoustic wave from an output transducer, comprising:

an input transducer sensing said input acoustic wave and providing an input signal;

an error transducer sensing the combined said output acoustic wave and said cancelling acoustic wave from said output transducer and providing an error signal;

an adaptive filter model adaptive modeling said acoustic system and having a model input from said input transducer and an error input from said error transducer and outputting a correction signal to said output transducer to introduce the cancelling acoustic wave such that said error signal approaches a given value;

a first lowpass filter filtering said input signal;

a first highpass filter filtering said input signal;

a second lowpass filter filtering said error signal;

a third lowpass filter filtering said error signal to a lower cut-off frequency than said second lowpass filter;

a second highpass filter filtering said error signal;

a third highpass filter filtering said error signal to a higher cut-off frequency than said second highpass filter;

the cut-off frequency of said third lowpass filter being greater than the cut-off frequency of said third highpass filter;

the frequency band between said first lowpass filter and said first highpass filter being greater than the frequency band between said third lowpass filter and said third highpass filter.

34. The invention according to claim 33 wherein the cut-off frequency of said second lowpass filter is less than the cut-off frequency of said first lowpass filter.

35. The invention according to claim 33 wherein the cut-off frequency of said second highpass filter is greater than the cut-off frequency of said first highpass filter.

36. The invention according to claim 33 wherein:

the cut-off frequency of said second lowpass filter is less than the cut-off frequency of said first lowpass filter;

the cut-off frequency of said second highpass filter is greater than the cut-off frequency of said first highpass filter.

* * * * *